United States Patent [19]

Dunand

[11] Patent Number: 4,801,154

[45] Date of Patent: Jan. 31, 1989

[54] LINKAGE DEVICE BETWEEN A CROSS-COUNTRY SKI AND A BOOT

[75] Inventor: Josiane Dunand, Cran Gevrier, France

[73] Assignee: Salomon S.A., Annecy Cedex, France

[21] Appl. No.: 925,921

[22] Filed: Nov. 3, 1986

[30] Foreign Application Priority Data

Nov. 26, 1985 [FR] France ..... 85 17442

[51] Int. Cl.[4] ..... A63C 9/00

[52] U.S. Cl. ..... 280/615; 280/611

[58] Field of Search ..... 280/611, 637, 612, 605, 280/607, 609, 615

[56] References Cited

U.S. PATENT DOCUMENTS

| | | | |
|---|---|---|---|
| 4,125,274 | 11/1978 | Kubelka et al. | 280/611 |
| 4,196,921 | 4/1980 | Sherwin | 280/615 |
| 4,280,714 | 7/1981 | Salomon | 280/611 |
| 4,360,218 | 11/1982 | Spademan | 280/611 |
| 4,403,790 | 9/1983 | Baver et al. | 280/611 |
| 4,410,199 | 10/1983 | Eisenberg | 280/615 |

FOREIGN PATENT DOCUMENTS

| | | |
|---|---|---|
| 0167726 | 2/1951 | Austria . |
| 0364632 | 11/1981 | Austria . |
| 0088673 | 9/1983 | European Pat. Off. . |
| 0163054 | 12/1985 | European Pat. Off. . |
| 0602623 | 8/1934 | Fed. Rep. of Germany . |
| 2633373 | 2/1978 | Fed. Rep. of Germany . |
| 2815167 | 10/1978 | Fed. Rep. of Germany . |
| 3528923 | 3/1986 | Fed. Rep. of Germany . |
| 2336152 | 7/1977 | France . |
| 2370488 | 6/1978 | France . |
| 2374059 | 7/1978 | France . |
| 2387062 | 11/1978 | France . |
| 2500312 | 8/1982 | France . |
| 2527932 | 12/1983 | France . |
| 2537011 | 6/1984 | France . |
| 2537010 | 6/1984 | France . |
| 8400498 | 2/1984 | PCT Int'l Appl. . |
| 8403225 | 8/1984 | PCT Int'l Appl. . |
| 0161590 | 5/1933 | Switzerland . |

*Primary Examiner*—Richard A. Bertsch

*Attorney, Agent, or Firm*—Sandler & Greenblum

[57] ABSTRACT

The present invention relates to a linkage apparatus between a ski boot and a cross-country ski which comprises a linkage blade which is pivotally mounted to a ski and which is attached to the toe end of the ski boot. In one embodiment, a sliding finger is biased by a compressing spring and constantly exerts a resilient pressure against an inclined forward surface of the linkage blade to maintain the blade in an equilibrium position, when at rest or inoperative, which is at an angle of about 20° with respect to the horizontal ski surface. In another embodiment, a compressible wedge is used to exert such a force on the blade, and the pivotable blade is attached directly to the forward surface of a ski boot.

60 Claims, 6 Drawing Sheets

LINKAGE DEVICE BETWEEN A CROSS-COUNTRY SKI AND A BOOT

BACKGROUND OF THE INVENTION

1. Technical Field of the Invention

The present invention generally relates to devices for linking skis to ski boots, and more particularly to devices for linking cross-country skis and cross-country ski boots which comprises structure connected to the toe of the boot and which is mounted pivotably on the ski about a horizontal axis which is transverse to the ski.

2. Description of Background

Material and Relevant Information

The prior art, e.g., French patent No. 2,537,011, discloses an apparatus for linking a ski boot to a cross-country ski which comprises a generally flat linkage element which is mounted pivotably on an end of the ski, around a horizontal axis which is transverse to the ski. This device has a free end which receives, via a member into which the toe end of the boot is adapted to be inserted, such ski boot toe. In one embodiment of the above-noted patent, a resilient device exerts a return motion on the linkage element which tends to press the linkage element against the upper horizontal surface of the ski, thus forcing the boot into a position in which it lies flat against the ski.

Similarly, the same general idea is used to provide a linkage apparatus in which the flat pivotable linkage element referred to in the above paragraph is integrally attached to one end of the boot and can be pivotally received in removable fashion on the ski itself.

The present Applicant, however, has performed numerous tests and studies on such devices which demonstrate that the return moment of the resilient member in the prior art did not form a desirable portion of the ski and boot system, particularly when the boot is only slightly spaced away from the ski. More particularly, when a skier is practicing traditional cross-country, i.e., alternating step skiing, it has been observed that for small spacing angles between the ski and the boot, e.g., on the order of between 0° and 20°, a return moment between the ski and the boot was not needed to maintain the ski along a desired track. Further, such moment comprised an increased resistance for a skier to overcome at the beginning of the pushing phase of a step in cross-country skiing when the boot begins to lift off of the ski, i.e., it was actually detrimental to the cross-country skiing motion Further, when cross-country skiing is performed in a half-step fashion, which is becoming more commonplace, or in a skating step fashion, it is normally observed after pushing that the ski undergoes a return phase during which it is entirely lifted from the ground and extends at an angle with respect to the general direction of displacement.

Yet, morphological studies have demonstrated that during this return phase of the ski, the sole of the foot of the skier does not extend along a horizontal plane, but is instead inclined with the tip of the foot being lower than the heel of the foot. With conventional linkage apparatus as discussed above, the ski being used by a skier will have the same inclination, and thus it will be necessary for a skier to lift his foot over a height which is sufficient to prevent the tip from becoming caught in the ground. It is clear that if the ski extended in a horizontal plane during this return phase of the ski, the skier would be able to lift his foot over a smaller height, thus reducing fatigue to the skier and enhancing performance.

It is accordingly an object of the present invention to overcome the deficiencies of the prior art and to provide a linkage apparatus between a ski boot and a cross-country ski which will minimize the height over which a skier must lift his foot during the return phase of the ski.

SUMMARY OF THE INVENTION

The present invention is provided for in a first aspect thereof by a linkage apparatus for attaching a ski boot and a cross-country ski. The linkage apparatus includes a blade which is adapted to be pivotably mounted on the ski about a substantially horizontal axis which is transverse to the longitudinal extent of the ski and is adapted to be connected to an end of the ski boot. The linkage apparatus further comprises means for resiliently exerting pressure on the linkage blade in the form of a return force whenever the linkage blade is moved, by an external force, away from an equilibrium position in which the sole of the ski boot is generally inclined with respect to the horizontal surface of the cross-country ski, and in which the heel of the boot is lifted with respect to the upper surface, the force exerting means comprises means for bringing the linkage element back into its equilibrium position after the external force is exerted.

The linkage apparatus includes a forward substantially planar surface adjacent the point at which the linkage blade is pivotably mounted to the ski, the resilient force exerting means comprises a rear planar surface which is adapted to resiliently contact the forward planar surface of the linkage blade. The two planar surfaces are adapted to orient themselves in a substantially parallel fashion in the absence of the application of external forces to the ski.

The planar surfaces are angularly offset from each other when the linkage blade is pivoted away from its equilibrium position. The planar surfaces thereby comprises means for resiliently exerting a return moment in opposition to the pivoting motion of the blade.

The contact plane between the planar surfaces can be substantially vertical; or, in the absence of external forces, can be inclined with respect to the vertical; or, the contact plane between the two planar surfaces, in the absence of external forces exerted on the blade, can be positioned forwardly of the pivot axis of the linkage blade; or, in the absence of external forces exerted on the blade, is located rearwardly of the pivot axis of the linkage blade.

In one embodiment, the resilient force exerting means comprises a slidable finger movable along the longitudinal axis of the ski under the influence of a compression spring. The force exerted by the compression spring is adjustable, and the compression spring extends substantially horizontally.

The finger and the compression spring are positioned within a housing which is integrally attached to a base plate forming a portion of the apparatus.

Alternately, the resilient force exerting means comprises an elastic block of material including the first planar surface. The block of material comprises an opposed surface which abuts an abutment member which is fixedly attached to an upper surface of the base plate.

The linkage blade is pivotably attached to the ski within spaced bearings along the upper surface of the ski; and each of the bearings comprises spaced fixed and movable members, the movable members being adapted to move towards the fixed members to close the bearings, wherein the linkage blade is integrally attached to a ski boot and is positioned within the bearings when the bearings are in their closed position.

The movable members of the two bearings are moved by a sliding cap which is adapted to slide along the longitudinal axis of the ski, the cap covering the resilient force exerting member. When the linkage blade is in its equilibrium position, the ski boot forms an angle of between approximately 5° and approximately 45° with respect to the upper surface of the ski, and preferably forms an angle of approximately 20°.

In another aspect of the present invention, an apparatus is provided for pivotably attaching a ski boot to a cross-country ski, with the apparatus comprising a pivotable blade adapted to be attached to the ski; means for attaching one end of the blade to the toe of the ski boot; means for pivotably attaching a second end of the blade to the ski; and means for maintaining the blade in an equilibrium position forming a predetermined angle with the ski. The maintaining means further comprises means for returning the blade to the equilibrium position after the blade is moved from the equilibrium position by application of an external force. The apparatus can further comprise a substantially flat plate adapted to be mounted to an upper surface of the ski, the maintaining means and the pivotable attachment means being positioned on the flat plate. The means for pivotably attaching the second end of the blade to the ski comprises two bearings spaced apart from each other in a direction transverse to the longitudinal extent of the ski.

The pivotable blade includes a forward end and spaced apart lateral pivots located at the forward end, each of the pivots being insertable into respective ones of the bearings; and the blade includes a front end, a rear end, an upper surface, and a lower surface.

A generally U-shaped support plate extends upwardly and rearwardly from the upper surface of the blade and comprises at least part of the means for attaching one end of the blade to the toe of the ski boot. A generally U-shaped bail can be attached to the two sides of the blade, the bail comprising means for fastening the boot toe to the blade. The rear end of the blade is preferably angled upwardly and forwardly, and the front end of the blade is angled upwardly and rearwardly.

An upper edge and a lower edge of the blade front can be arcuate. The front end of the blade can be substantially vertical; or angled upwardly and forwardly; or can have an upper edge which curves rearwardly at a point adjacent to, and located slightly above, the mid-height point of the blade.

The rear end of the blade is integrally attached to a front end of the ski boot. The means for maintaining the blade in an equilibrium position comprises a resiliently biasing member which is adapted to resiliently abut a forward end of the blade when the blade is pivotably connected to the ski. The resiliently biasing member may comprise a finger which is moveably biased along the longitudinal extent of the ski by a helical spring, with the finger and the spring being located within a generally rectangular casing. The finger includes a flange at a forward end thereof, the flange comprising means for engaging a flange located on an interior surface of the casing to limit rearward movement of the finger through an opening in a rear wall of the casing. The compression of the spring is controlled by a screw which is threadably connected within an internally threaded bore located at a forward end of the casing. Alternately the resiliently biasing member comprises a compressible block of material positioned between the spaced bearings which comprise at least part of the means for pivotably attaching the blade to the ski. This block comprises a rear surface which is adapted to abut the front end of the blade and a front surface which is adapted to contact an abutment member positioned on the ski. The block is substantially rectangular and the front and rear block surfaces are substantially vertical; or the front surface of the block is substantially vertical and the rear surface of the block is angled upwardly and forwardly or the front surface of the block is substantially vertical and the rear surface of the block is angled upwardly and rearwardly.

The front blade surface and a rear surface of the resiliently biasing member abut each other adjacent a substantially horizontal axis which is located transverse to the horizontal extent of the ski and which is located within the means for pivotably attaching a second end of the blade to the ski. The plane of abutment is substantially vertical and is located along the axis; or the plane of abutment is substantially vertical and is located forwardly of the axis; or the plane of abutment is substantially vertical and is located rearwardly of the axis; or the abutment plane is angled upwardly and rearwardly and intersects the axis; or the plane of abutment is angled upwardly and forwardly and intersects the axis; or the plane of abutment is angled upwardly and rearwardly and is located entirely forwardly of the axis; or the abutment plane is angled upwardly and rearwardly and is located entirely rearwardly of the axis; or the plane of abutment is angled upwardly and forwardly and is located forwardly of the axis; or the abutment plane is angled upwardly and forwardly and is located rearwardly of the axis.

The means for pivotably attaching a second end of the blade to the ski comprises a pair of spaced bearings, each of the bearings comprising a stationary member and a moveable member extending upwardly from the ski. The apparatus further comprises a slidable casing surrounding the means for maintaining the blade at an equilibrium position, the slidable casing comprising means for forcing the moveable bearing members towards the stationary bearing members. The stationary members extend upwardly from a base, the stationary members being arcuate in configuration and curved forwardly with respect to the extent of the ski; and the moveable members of each of the bearings comprise side walls of the casing with an arcuate surface curved rearwardly with respect to the longitudinal extent of the ski. Respective arcuate members are adapted to engage respective lateral pivots at a forward end of the blade; and the casing also comprises a slidable cap. The predetermined angle is between approximately 5° and approximately 45°, and is preferably approximately 20°.

BRIEF DESCRIPTION OF THE DRAWINGS

The present invention will now be described with reference to the annexed drawings, in which like reference numerals describe like parts throughout, and wherein the invention is illustrated by way of non-limiting example only, as follows.

DESCRIPTION OF PREFERRED EMBODIMENTS

The present invention attempts to overcome the disadvantages of the prior art by providing a linkage apparatus between a cross-country ski and a cross-country ski boot in which a number of forces which are presently needlessly exerted by a cross-country skier will be attenuated.

To this end, the linkage apparatus comprises an elastic or resilient device which is connected to the apparatus so as to exert on the linkage member a return force as soon as the linkage member is spaced by an exterior force from either side of an equilibrium position in which the sole of the boot is generally inclined, and when the heel is lifted from the upper surface of the ski. The return force exerted by the resilient member will serve to bring the linkage element back into the equilibrium position in which the sole of the boot is so generally inclined.

According to another advantage of the present invention, the linkage element comprises a planar surface which is located adjacent to the point at which it pivots about the ski; and a resilient member which also comprises a planar surface which is resiliently abutted against the planar surface of the linkage element to bring the linkage element into a position in which it is parallel with respect to the planar surface of the resilient member, in the absence of externally applied forces. The planar surfaces of each of the linkage element and of the resilient member extend both above and below a horizontal pivot axis of the linkage member. In this fashion, pivoting motion of the linkage element with respect to its equilibrium position, when effected by an external force results, in an annular offset between the two planar surfaces and in mutual contact between the resilient member and the linkage element. This system thus exerts, by resilient or elastic pressure, a return moment which opposes any such pivoting.

The angle of inclination of the linkage element with respect to the ski in its equilibrium position is between about 5° and 45°, and preferably on the order of 20°.

Figure 1:
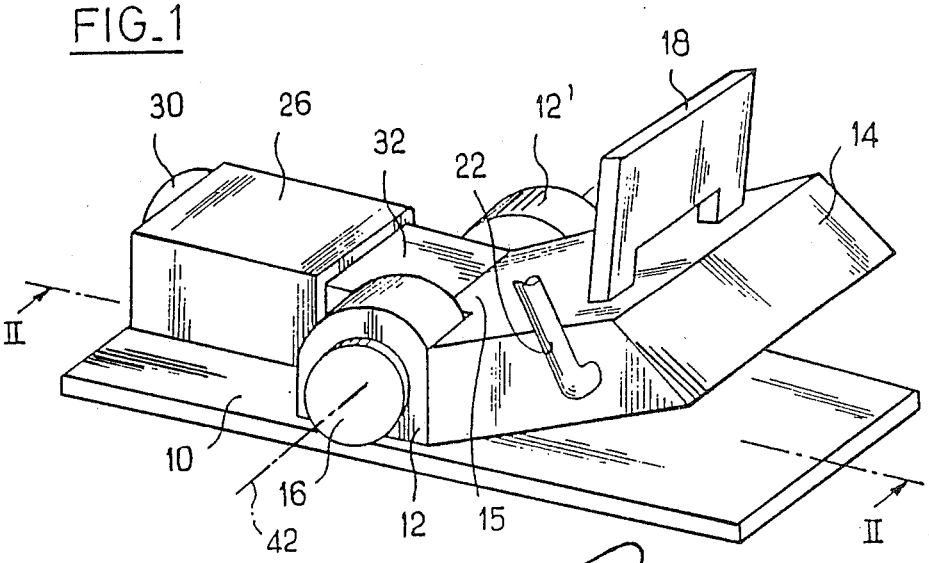
FIG. 1 is a perspective view of a linkage apparatus formed in accordance with a first embodiment of the present invention.
Figure 2:
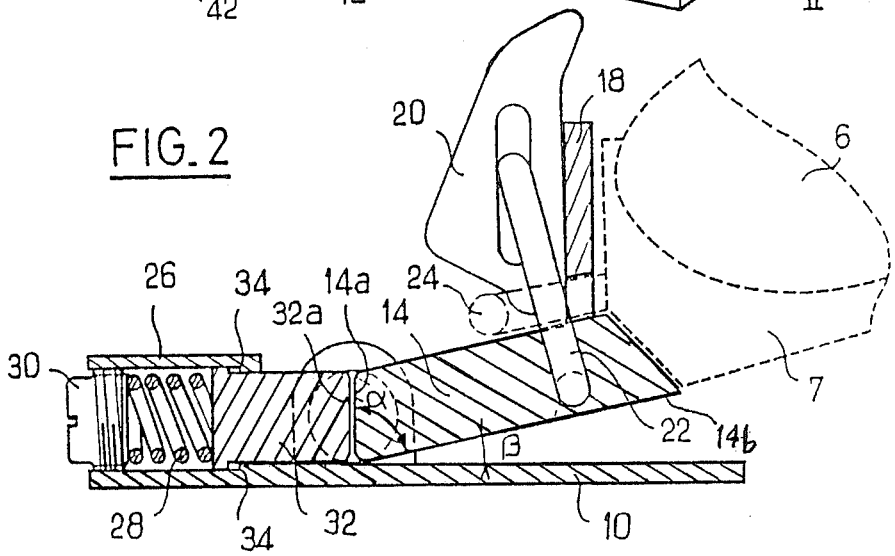
FIG. 2 is a longitudinal cross-sectional view taken along line II—II of the apparatus of FIG. 1.
Figure 3:
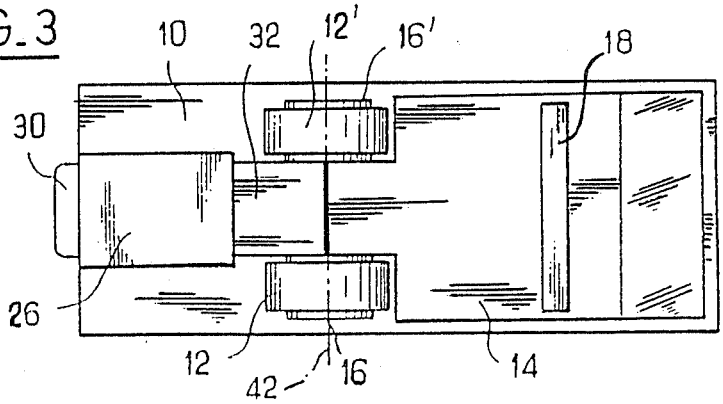
FIG. 3 is a top view of the apparatus of FIGS. 1 and 2.
Figure 4:
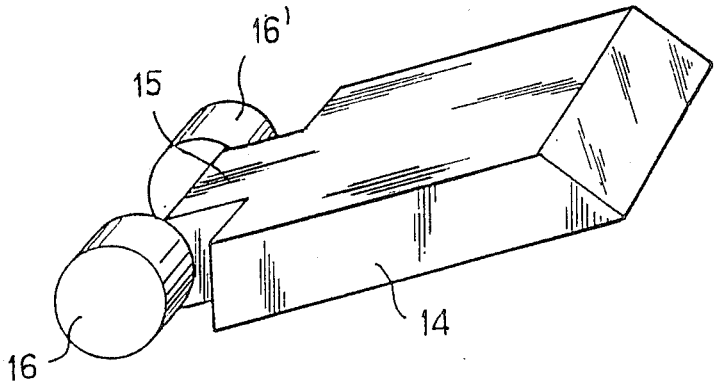
FIG. 4 is a perspective view of one portion of the linkage assembly of FIGS. 1–3.

The linkage apparatus which is illustrated in FIGS. 1–3 comprises a base member which generally has the form of a plate 10 which is substantially rectangular. Two bearings 12 and 12' are positioned laterally adjacent the middle of plate 10, in spaced fashion along opposite edges of the plate. Rigid blade 14 comprises a movable linkage element which extends globally over a rear portion of plate 10, and substantially over the entire width of the plate. Blade 14 has a reduced width or thickness front end portion 15 so that it can be inserted between bearings 12 and 12', as best seen in FIG. 3 In this area of reduced thickness, rigid blade 14 comprises two substantially cylindrical, lateral pivots 16 and 16' which engage respective bearings 12 and 12', again as shown in FIG. 3. Rigid blade 14 is thus pivotable with respect to plate 10 about a horizontal axis 42 which is substantially transverse to the ski on which it is positioned. Blade 14 is best illustrated alone in FIG. 4.

As best seen in FIG. 2, pivotable blade 14 has, in longitudinal cross-section, a trapezoidal configuration. More particularly, its front end surface **14*a* defines with the lower planar surface 14*b* an angle alpha (see FIG. 2) of approximately 70°. The upper and lower edges of surface 14*a* are slightly rounded, and the surface extends both above and below pivot axis 42, which in the example of FIGS. 1–3 lies in the plane of surface 14*a***.

Further, a device for inserting the boot into the blade is located in the front portion of the movable blade, which permits removable assembly of the toe end of a cross-country ski boot 6 (see FIG. 2) within the extension of blade 14. This apparatus is basically shown schematically in the Figs. and includes an upwardly (and rearwardly) extending support plate 18 which is directed substantially upwardly and is mounted rigidly on the rear end portion of the upper surface of movable blade 14; and as is indicated by the dotted lines in FIG. 2, a lever is provided to receive an inserted ski boot 20 in a journalled fashion with respect to blade 14 by engagement with a stirrup 22 which is substantially U-shaped and which is inserted into opposite apertures along the sidewalls of blade 14. The lever or stirrup is adapted to cooperate with a ring 24 formed in a rearward end 7 of shoe 6. The structural and functional details of this mechanism are not further described in detail, but are illustrated in commonly assigned U.S. patent application Ser. No. 558,858 (French patent No. 2,537,011), which application is expressly incorporated herein by reference.

The linkage apparatus of the present invention further comprises means for resiliently biasing the front end surface **14*a* of pivotable blade 14. This apparatus includes a cage or housing 26 provided on a front portion of plate 10 which can have, as illustrated in this embodiment, a relatively square transverse cross-sectional configuration. The configuration can, of course, have any appropriate configuration which would be adapted to receive the resilient spring 28. A compressed helical spring 28 is positioned within the cage or housing and has a rear end which abuts against a seat defined by a screw 30 which is adjustably and threadably connected into an appropriately threaded interior opening at a front end of cage 26. The other end of spring 28 contacts the front end surface of a slidable finger or member 32. The sliding finger has a transverse cross-section which permits it to slide longitudinally, with a minimum clearance, along the rear portion of cage 26, and permits a portion of the finger to extend beyond the cage so that its rear surface 32*a* can abut against the front end surface 14*a* of pivoting blade 14, in the region substantially between bearings 12 and 12'. This contact is best illustrated in FIGS. 2 and 3. In the present example, surface 32*a* of sliding finger 32 is substantially vertical and extends both above and below pivot axis 42. In the embodiment illustrated, angle alpha of surface 14*a* will define the "at rest inclination" of blade 14** with respect to the horizontal, as discussed herein.

The interior surface of cage 26 includes a shoulder or flange 34 both along its top and bottom surfaces which reduces the cross-section of the cage adjacent its front opening, and limits movement of sliding finger 32 by engaging the flange on the finger.

Complementary uncoupling or decoupling is provided by the front end portion of sliding finger 32. Thus, an end point abutment is defined towards the front of finger 32, so as to prevent the finger from completely leaving the cage, e.g., engagement of flange 34 and the finger flange prevents the finger from leaving the cage when pivoting blade 14 upon which it rests is removed. In other words, the rear flange of finger 32 prevents the finger from decoupling from the cage or housing.

Further, screw 30 can be screwed to a desired extent into the tap or threaded associated opening of cage 26. In this fashion, one can control the degree of compression of spring 28, and thus can control the biasing force exerted on surface 14*a* of pivoting blade 14 with respect to finger 32.

The operation of the linkage apparatus which has been described above will now be set forth. At rest, as in the position of FIGS. 1–3, compression spring 28 tends to resiliently force sliding finger 32 rightwardly, to force surface 32*a* into abutment with the inclined front surface 14*a* of blade 14. As a result of the pivoting motion which blade 14 undergoes within bearings 12 and 12', the front inclined surface of blade 14 will tend to spontaneously orient itself in a parallel fashion with respect to adjacent surface 32*a* of finger 32, i.e., vertically as shown in FIG. 2, along a contact plane which includes axis 42. It should thus be understood that when the pivoting blade is not subjected to any external biasing force, and particularly when no ski boot is attached to the blade, it will automatically and spontaneously assume the equilibrium position illustrated in FIGS. 1–3 in which it has an upward inclination as illustrated in the Figs., i.e., an angle of inclination beta of approximately 20° (which is an angle which is complementary to the angle alpha of 70° defined by the rear surface 14*a* of the blade) with respect to the horizontal. Blade 14, however, can assume any other angular inclination which would result from the application of external stresses or forces. When such forces would be applied, surfaces 14*a* and 32*a* of blade 14 and finger 32, respectively, will no longer be parallel to one another, which will permit finger 32, biased by compression spring 28, to exert on blade 14 a return moment which will tend to bring the blade back into its equilibrium position. The rounded edges of surface 14*a* make it possible to reduce the friction exerted between surfaces 14*a* and 32*a* when they leave their parallel relationship.

Figure 5:
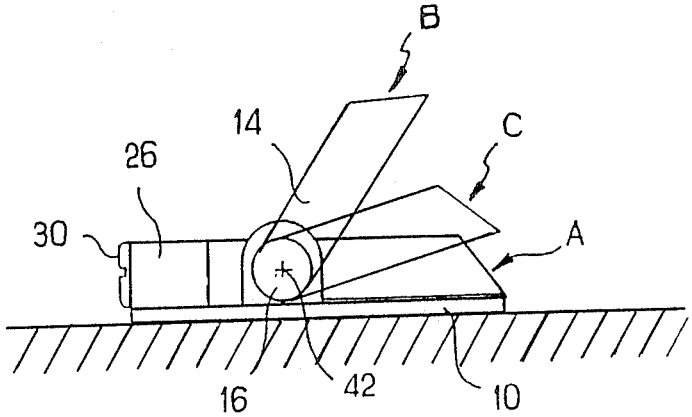
FIG. 5 is a schematic side view which is useful in illustrating and understanding operation of the apparatus of FIGS. 1–4.

Attention is now directed to FIG. 5 in order to explain the advantageous consequences of using the structure of FIGS. 1–4 during cross-country skiing. FIG. 5 is a schematic side view which illustrates several possible inclinations of pivotable blade 14.

When a skier performs a traditional diagonal or alternating step, each such alternating step will first comprise a pushing phase, during which the end of the ski boot will pivot integrally with pivoting blade 14, between horizontal position A and a maximum inclination position B (at approximately a 60° angle with respect to the horizontal) as illustrated in FIG. 5. The equilibrium position of blade 14, while not in use, is illustrated at position C in FIG. 5 at an angle of approximately 20° with respect to the horizontal During the first portion of movement, between positions A and C, the linkage apparatus of the present invention will aid a ski boot in lifting off of the ski, by virtue of the fact that compression spring 28 will always tend to bring blade 14 back into position C. Such a return operates almost as a propeller which serves to accentuate the initial forces of the skier, without however compromising proper maintenance of the ski within the track which occurs spontaneously at that time.

Further, between positions C and B, a movement occurs during which blade 14 will offer progressive resistance against pivoting motion.

During the return phase of the ski towards its front position, which occurs after the pushing movement, the blade first undergoes movement from position B towards position C, during which time the blade 14 will tend to bring the ski and the boot together. This will effect a moment between the shoe and the ski which will tend to maintain the tip of the ski pressed against the ground in order to contribute, during the critical phase of skiing in which the weight of the skier is not substantially applied to the ski, the ski pressed against the ground, thus maintaining the ski in the track along which the skier is moving.

The end of the return phase corresponds to movement of blade 14 from position C towards position A. At this point, the weight of the skier, which will again be progressively applied to the ski, is alone sufficient to bring blade 14 back into position A by compressing spring 28.

In this fashion, utilizing the weight of the skier, spring 28 is compressed, thereby accumulating energy which will be restored during the beginning of the next pushing phase, i.e., it will be restored and used at a time which is particularly critical to increase the efficiency of the step of the skier.

Throughout the proceeding description, the inoperative equilibrium position C of blade 14 has been indicated to form an angle of approximately 20° with respect to the horizontal. It should be clear that such an angle can be modified or altered within relatively broad limits without compromising the above-noted advantages, particularly with respect to the accumulation of energy in the spring which will later be advantageously used. By way of example, this angle can be between 5° and 45° and still achieve the beneficial results of the present invention.

The linkage apparatus as described above similarly provides advantages during half-step or full-step skating type skiing.

As indicated previously, in this type of step, the return phase of the ski involves completely lifting the ski; and the general position of the body of the skier at the time of lifting is such that the skier's foot is inclined generally downwardly at an angle of approximately 20° with respect to the horizontal, downwardly from the heel towards the toes of the foot. In this skiing phase, during which the ski is not subjected to any external force, it should be understood that the linkage apparatus will spontaneously assume its equilibrium position, i.e., that the ski boot and the ski will together define an angle of approximately 20° with respect to the horizontal. This makes it possible for the ski to assume a substantially horizontal orientation during its return phase while the foot preserves its natural inclination. As a result, it will only be necessary to slightly lift one foot in order to lift the ski upwardly towards the front without being caught on the ground. Again, the present apparatus will contribute to attenuating any unnecessary efforts of the skier during skiing.

The angles which have been described above have been given by way of non-limiting examples only; specifically, any equilibrium position of the linkage apparatus which will serve to attenuate inclination of the ski with respect to the plane of the ground during the return phase of the ski in cross-country skiing will be satisfactory. FIGS. 6–17 illustrate, in longitudinal cross-section, a number of alternative embodiments of structure which can be used for the pivoting region of the blade, i.e., in the area where the front surface of the blade contacts the free rear end of the sliding finger. In all of these Figs., identical elements or parts have been designated by similar reference numerals throughout. The modifications illustrated in these Figs. have been adapted to vary the relationship between the angle of inclination of the pivoting blade along both sides of its equilibrium position and the return moment on the blade which is exerted during return.

Figure 6:
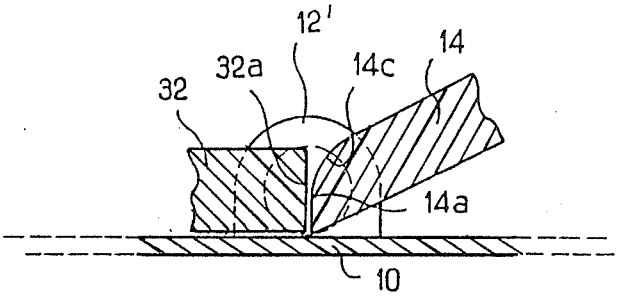
FIGS. 6–17 are median, longitudinal cross-sectional schematic views of alternative embodiments of the apparatus of FIGS. 1–5.

In FIG. 6, the apparatus is structured similarly to that as illustrated in FIGS. 1–4. The only difference is that the upper region of the front end surface 14*a* of pivoting blade 14 is rounded at region 14*c* - so that continuation of surface 14*a* to the upper surface of blade 14 will occur without breaking or without any noticeable bending.

Such modification has, as a first object, attenuation of the return moment and a more progressive change in the return moment when pivoting blade 14 is lifted from position C to position B, as shown in FIG. 5. It similarly prevents, during pivotal motion of blade 14 from position C towards position B, any "hard point" or unstable equilibrium position. This might otherwise occur as a result of the fact that the contact region between surface 14*a* and the contacting surface of finger 32 would be located below the height of the pivot axis of the blade, which would thereby reverse the direction of the return moment.

Figure 7:
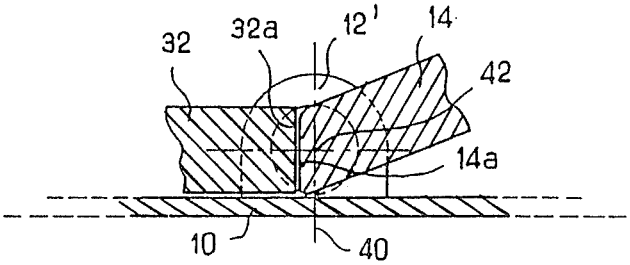

In FIG. 7, end surfaces 14*a* and 32*a* of pivoting blade 14 and finger 32, respectively, have substantially the same orientation as in the embodiment of FIGS. 1–4. In this embodiment, however, the plane of contact between these two surfaces has been offset forwardly so that it is located in front of vertical plane 40 which passes through pivot axis 42 of the blade.

Figure 8:
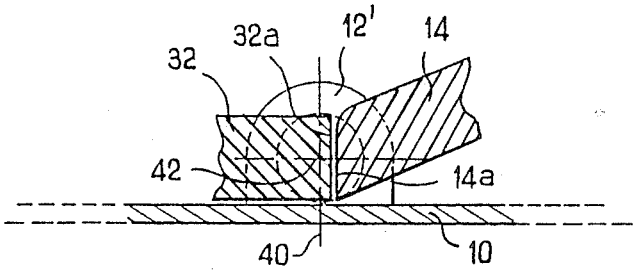

In FIG. 8, the inclination of surfaces 14*a* and 32*a* are again identical to those of the preceeding Figs., but the contact plane, at rest, between the surfaces is located rearwardly of vertical plane 40 which extends through pivot axis 42 of the blade.

Figure 9:
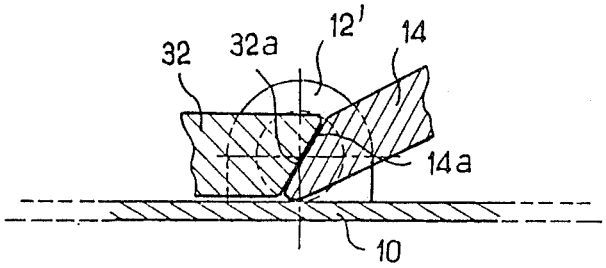

In FIG. 9, surfaces 14*a* and 32*a*, at rest, are in mutual contact and have been modified so that they are inclined, in a clockwise orientation upwardly and rearwardly with respect to the vertical. In this embodiment, the angle of inclination is approximately 30°, and the contact plane between the two surfaces when at rest passes through pivot axis 42 of the blade. Within the scope of the invention, the angle of inclination of the surface can be provided with any appropriate value which still achieves the advantages of the invention.

Figure 10:
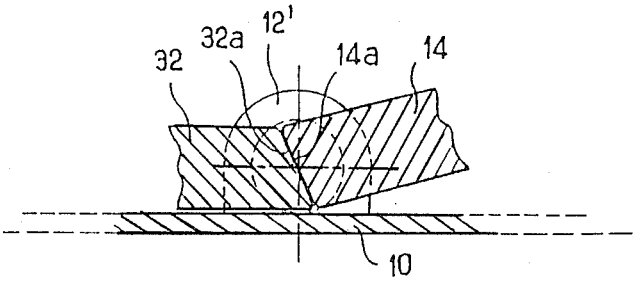

In FIG. 10, respective surfaces 14*a* and 32*a* of blade 14 and finger 32 are inclined, when at rest, in a counterclockwise direction, angled upwardly and forwardly, with respect to the vertical. However, again, the plane of contact between the surfaces passes through pivot axis 42 of the blade.

Figure 11:
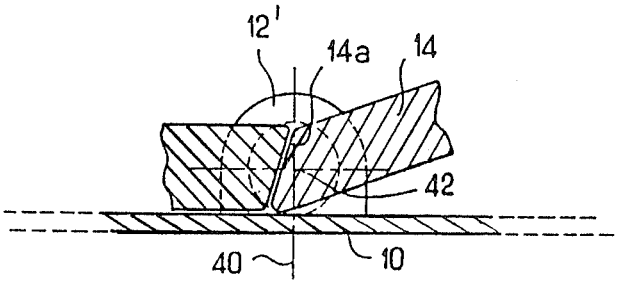

FIG. 11 illustrates another alternative embodiment of the contacting surfaces which is generally similar to that of FIG. 9. However, the plane of contact, which is inclined as in FIG. 9, has been forwardly offset from the apparatus such that pivoting axis 42 is now situated rearwardly of the plane.

Figure 12:
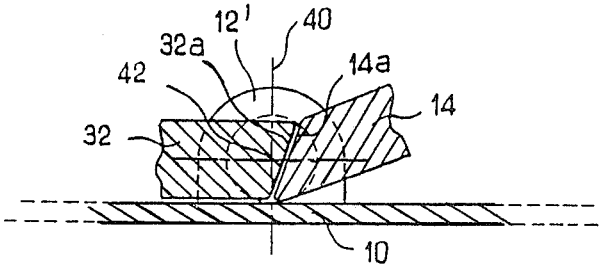

In FIG. 12, an offset in the reverse direction from that of FIG. 11 has been provided. More particularly, the contact plane between surfaces 14*a* and 32*a* is offset rearwardly in order to permit pivot axis 42 to be positioned in front of the contact plane.

Figure 13:
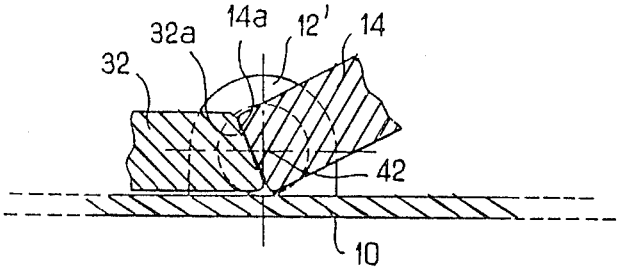
Figure 14:
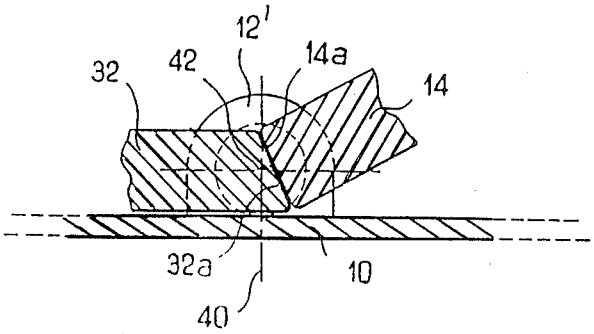

In the embodiments of FIGS. 13 and 14, the plane of contact between surfaces 14*a* and 32*a* is inclined as illustrated in FIG. 10, but is offset so that it is, respectively situated in front and to the rear of pivot axis 42 of blade 14.

Figure 15:
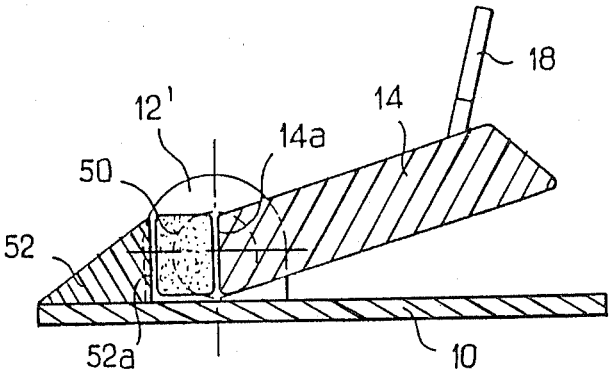

FIG. 15 illustrates another linkage apparatus in which the member for biasing the front end of pivoting blade 14, in the area where it pivots, relies upon a different principle. Several of the elements of FIGS. 1–4 are included in FIG. 15, i.e., pivoting blade 14, front end surface 14*a* upon which the elastically biasing means acts, support plate 18 which is adapted to receive, together with the rear end of blade 14, the toe end of the ski boot, and the cylindrical pivots which are received in bearings, e.g., bearings 12 and 12', which are integrally attached to base plate 10.

However, the elastic means which bias blade surface 14*a* comprise, instead of a helical spring, a block or stopper 15 formed of an elastically deformable material, e.g., an appropriate rubber material. The forward surface of block 50, which is opposite the surface 14*a* of blade 14, rests against a vertical wall 52*a* of an abutment element 52 which is integrally attached to the upper surface of base plate 10 in a front region of the base plate.

The operation of this apparatus is generally analogous to that of the device of FIGS. 1–4. Thus, when the pivoting blade 14 is spaced from its equilibrium position, its inclination is defined by the respective inclinations of surface 14*a* and of the adjacent surface of elastic block 50; and the block 50 will tend to be compressed and to exert a return force rearwardly (rightwardly in the FIG.) as do the coupled finger and spring assembly of FIGS. 1–4.

In the embodiment of FIG. 15, the surfaces of blade 14 and of block 50 which are in mutual contact extend, when at rest or in inoperative position, substantially vertically.

Figure 16:
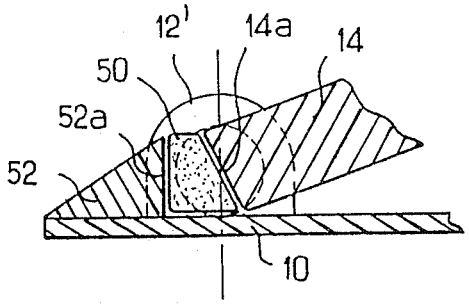

FIG. 16 illustrates an alternative embodiment in which the contact surfaces of blade 14 and block 50 are inclined in a counterclockwise direction, upwardly and forwardly, with respect to the vertical, with the thickness of the compressible block being reduced progressively from its bottom towards its top. In this manner different return moments will be obtained, depending upon whether the blade is displaced upwardly or downwardly from its equilibrium position.

Figure 17:
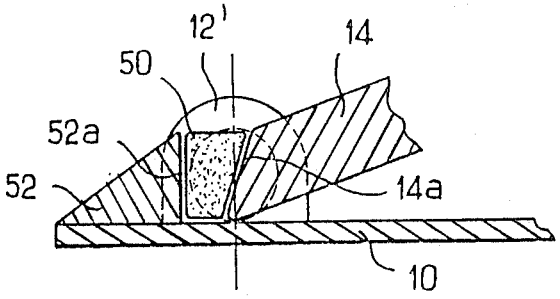

FIG. 17 illustrates the contact surfaces of blade 14 and of block 50 as being inclined in a clockwise direction with respect to the vertical, with the thickness of the block diminishing progressively from the top of the block towards the bottom fo the block.

It should be understood that any variation in the embodiments described above will modify the action of the apparatus during pivoting motion of blade 14 on both sides of the equilibrium position. It is unnecessary, however, to indicate in each case the result of such operation. It should be understood by one of ordinary skill in the art, however, how to modify, both by calculation and/or empirically, the respective profiles of surfaces 14*a* and 3*a* in a manner which will impose any desired relationship between the pivoting angle of pivoting blade 14 in one or more directions with respect to its equilibrium position, as well as the return moment which is exerted. It should likewise be appreciated how friction between surface 14*a* of the blade and the associated surface of the elastic or resilient pressure exerting member can be reduced and thus may become less detrimental to proper operation of the linkage apparatus.

Further, FIGS. 6–14 describe and illustrate embodiments of the present invention in which the profiles of surfaces 14*a* and 32*a* of blade 14 and pressure finger 32, respectively, are substantially straight. It is apparent that one could use curved, bent, or otherwise configured profiles in order to obtain a desired return effect.

It is noted, however, that in all of the embodiments of the invention, the profile of the respective surfaces of the sliding finger and of the pivoting blade are adapted so that when at rest the blade will assume an upward inclination, i.e., it will be upwardly inclined at any angle between 5° and 45°.

With respect to FIGS. 18 and 19, a linkage apparatus formed in accordance with the present invention will now be described in which yet a different principle for inserting the ski boot is utilized. In this embodiment, the pivoting plate is integrally attached to the end of the boot, and can be selectively positioned on the ski, with the pivoting axis being received in a removable fashion within associated bearings on the base plate.

More particularly, a ski boot 106 which is specially adapted for use in cross-country skiing extends forwardly, in a unitary fashion with sole 108, via a blade 114 which is substantially rigid and integrally formed with the sole. The blade has a substantially rectangular transverse cross-section and has a slightly reduced height towards its forward edge. The front edge of blade 114 is provided with two laterally positioned pivots 116 and 116'. Between these two pivots a front forward surface 114*a* of the blade is provided on which a return function is exerted in a manner similar to the manner in which it was exerted in previous embodiments of the invention. The portion of the linkage apparatus which is at rest when on the ski comprises a horizontal base plate 110 which is adapted to receive a variety of elements including a sliding finger mechanism 132 and a spring (not illustrated) which are analogous to the devices in FIGS. 1–4 and will therefore not be described in greater detail herein.

Lateral bearings are provided to receive pivots 116 and 116' of blade 114; these bearings include fixed portions 112*a* and 112*a'*, which serve as first half-bearings mounted in a fixed manner on base plate 110, and by rear portions 112*b* and 112*b'* forming sidewalls of sliding cap member 136, which replace the second half of the bearings of the previous embodiments.

Figure 18:
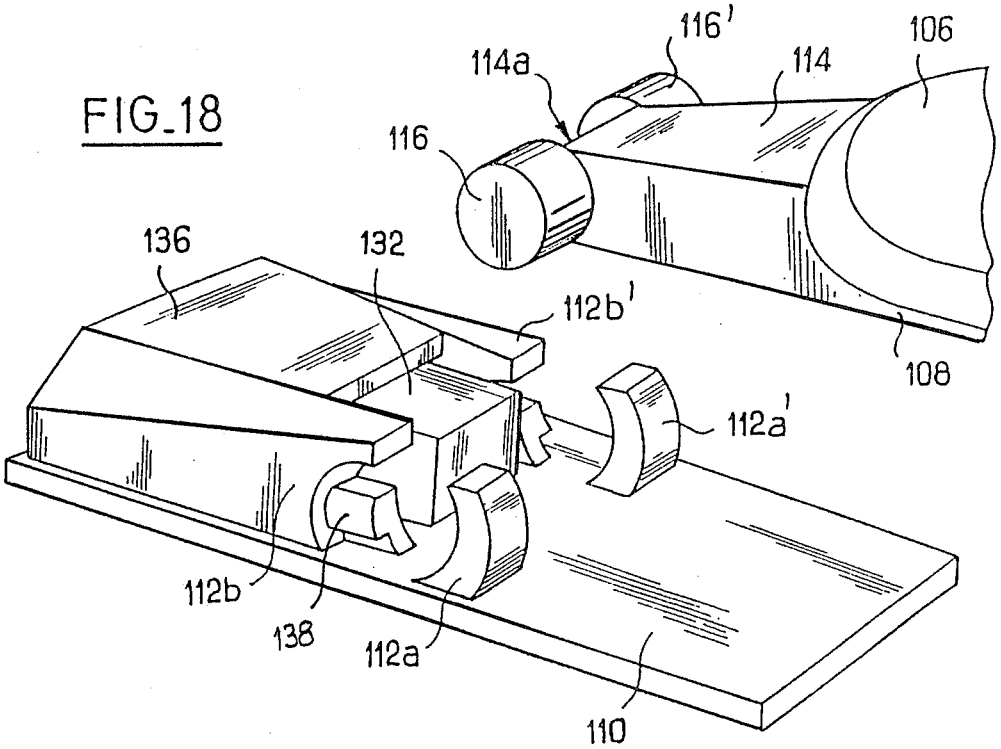
FIG. 18 is a perspective view of an apparatus formed in accordance with another embodiment of the invention, and illustrates the apparatus prior to attachment of a ski boot onto the ski.
Figure 19:
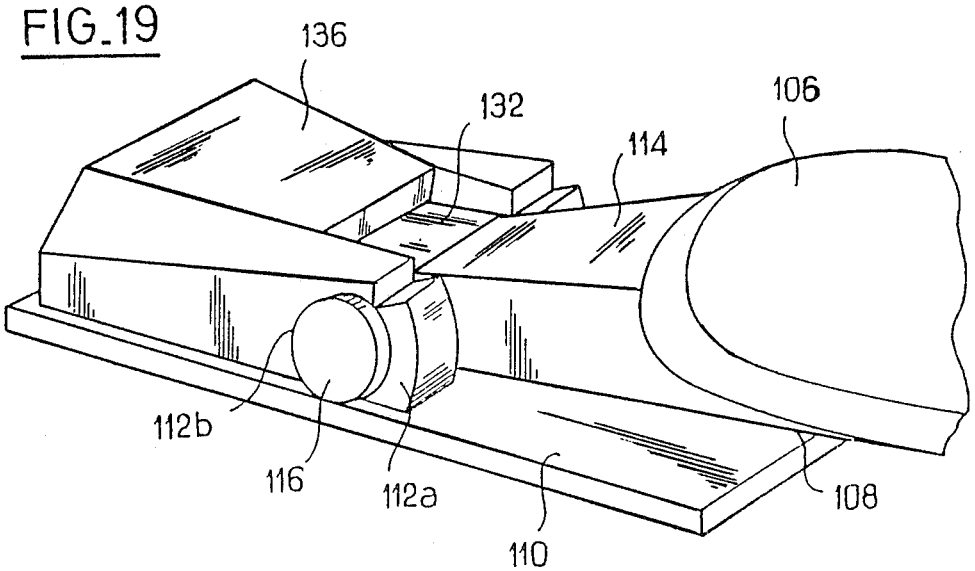
FIG. 19 is a perspective view of the apparatus of FIG. 18 after attachment of the boot onto the ski.

Cap 136 is slidably mounted on lateral guide rails 138 and a mechanism having one or more return springs (not illustrated) is provided which is elastically and resiliently connected to cap 136 in order to bias the cap towards the rear of this apparatus, i.e., rightwardly in FIGS. 18 and 19, into a position so that portions 112*b* and 112*b'* of the bearing will abut against portions 112*a* and 112*a'*, thereby defining the closed position of the bearings which are each adapted to imprison or capture a respective pivoting element of blade 114.

In FIG. 18, the apparatus is shown in a position which is adapted to receive a boot to be inserted, i.e., it is in its open position. More particularly, cap 136 has been displaced forwardly, e.g., manually, such that the two half-bearings positioned on either side of the apparatus will be open while permitting, along and through their upper regions, passage of pivot members 116 and 116'.

In FIG. 19, to the contrary, pivots 116 and 116' have already been positioned within the bearings, i.e., the ski boot has been inserted, and cap 136 has been freed so that it assumes its extreme rear position. In this FIG., bearings 112*a*, 112*b*, 112*a'* and 112*b'* are enclosed and have captured or imprisoned pivots 116 and 116'.

After the ski boot has been inserted as illustrated in FIG. 19, the apparatus will operate in an appropriate manner analogous to the basic apparatus of FIGS. 1–4. More particularly, finger 132, which will be subjected to the action of the spring (which is positioned within a cage or housing covered by cap 136 and which is therefore not visible in FIGS. 18 and 19) will act on the forward surface of blade 114 to exert on its forward surface a return moment as soon as the blade is spaced from its stable or rest equilibrium position, and inclined with respect to the horizontal by an angle which is between 5° and 45°, and preferably on the order of approximately 20°. As in all other embodiments of the present invention, the inclination of the pivoting blade, when at rest, is defined by respective inclinations of its surface 114*a* and of the adjacent surface of the resiliently biasing element, i.e., the finger or stopper, which transmits elastic pressure to the forward surface of the blade.

It should be understood that all of the alternate embodiments illustrated in FIGS. 6–17 can similarly be applied in cases in which the pivoting blade is mounted permanently on the ski, as shown in FIGS. 1–4, as well as in cases in which the pivoting blade is mounted on the front of a ski boot and is thus mounted to the ski in a removable fashion.

In another sense, it is possible to use the linkage apparatus of the present invention in such a manner that the angle of the pivoting blade when in the equilibrium position is adjustable. More particularly, a wedge having non-parallel surfaces could be positioned between the support surface of sliding finger 13 or bumper 50 and the support surface of pivoting blade 14.

Similarly, in order to perform such an adjustment, a plurality of fingers 32 or blocks 50 can be provided which are interchangeable and which have surfaces which are adapted to cooperate with surface 14*a* or 114*a* of blade 14 or 114, respectively, having different inclinations.

Of course, the present invention is not limited to the particular embodiments described herein, but extends to all equivalent means, materials, and embodiments within the scope of the claims.

What is claimed is:

1. A linkage apparatus for attaching a ski boot and a cross-country ski, said linkage apparatus comprising a blade which is adapted to be pivotably mounted on said ski about a substantially horizontal axis which is transverse to the longitudinal extent of said ski and which is adapted to be connected to an end of said ski boot, said linkage apparatus further comprising means for exerting, on said linkage blade, a return force whenever said linkage blade is moved by an external force away from an equilibrium position in which the sole of said ski boot is generally inclined with respect to the upper surface of said cross-country ski, and in which the heel of said boot is lifted with respect to said upper surface, said exerting means comprising means for bringing said linkage blade back into its equilibrium position after said external force is exerted.

2. A linkage apparatus in accordance with claim 1 wherein said linkage apparatus includes a forward substantially planar surface adjacent said point at which said linkage blade is pivotably mounted to said ski, said force exerting means comprising a rear planar surface which is adapted to resiliently contact said forward planar surface of said linkage blade, said two planar surfaces being adapted to orient themselves in a substantially parallel fashion in the absence of the application of external forces to said ski.

3. A linkage apparatus in accordance with claim 2 wherein said planar surfaces are angularly offset from each other when said linkage blade is pivoted away from said equilibrium position, said planar surfaces thereby comprising means for resiliently exerting a return moment in opposition to said pivoting motion of said blade.

4. A linkage apparatus in accordance with claim 2 wherein said contact plane between said planar surfaces is substantially vertical.

5. A linkage apparatus in accordance with claim 2 wherein said contact plane between said two planar surfaces, in the absence of external forces, is inclined with respect to the vertical.

6. A linkage apparatus in accordance with claim 2, wherein said contact plane between said two planar surfaces, in the absence of external forces exerted on said blade, is positioned forwardly of the pivot axis of said linkage blade.

7. A linkage apparatus in accordance with claim 2 wherein said plane of contact between said two planar surfaces, in the absence of external forces exerted on said blade, is located rearwardly of said pivot axis of said linkage blade.

8. A linkage apparatus in accordance with claim 2, wherein said force exerting means comprises a slidable finger movably mounted along the longitudinal axis of said ski, and a compression spring which is adapted to move said slidable finger.

9. A linkage apparatus in accordance with claim 8 wherein the force exerted by said compression spring is adjustable.

10. A linkage apparatus in accordance with claim 8 wherein said compression spring extends substantially horizontally.

11. A linkage apparatus in accordance with claim 8 wherein said finger and said compression spring are positioned within a housing which is integrally attached to a base plate forming a portion of said apparatus.

12. A linkage apparatus in accordance with claim 2 wherein said force exerting means comprises an elastic block of material including said first planar surface.

13. A linkage apparatus in accordance with claim 12 wherein said block of material comprises an opposed surface which abuts an abutment member which is fixedly attached to an upper surface of said base plate.

14. A linkage apparatus in accordance with claim 1 wherein said linkage blade is pivotally attached to said ski within spaced bearings positioned on the upper surface of said ski.

15. A linkage apparatus in accordance with claim 14 wherein each of said bearings comprises spaced apart fixed and movable members, said movable member being adapted to move towards said fixed member to close said bearings, wherein said linkage blade is integrally attached to a ski boot and is positioned within said bearings when said bearings are in their closed position

16. A linkage apparatus in accordance with claim 15 wherein the movable members of said two bearings are moved by a sliding cap which is adapted to slide along the longitudinal axis of said ski, said cap covering said resilient force exerting member.

17. A linkage apparatus in accordance with claim 1 in combination with a ski boot, wherein when said linkage blade is in its equilibrium position said ski boot forms an angle of between approximately 5° and approximately 45° with respect to the upper surface of said ski.

18. A linkage apparatus in accordance with claim 17 wherein said is 20°.

19. Apparatus for pivotably attaching a ski boot to a cross-country ski, said apparatus comprising:

(a) a pivotable blade adapted to be attached to said ski;

(b) means for attaching one end of said blade to the toe of said ski boot;

(c) means for pivotably attaching a second end of said blade to said ski; and (d) means for maintaining said blade in a predetermined equilibrium position with respect to said ski, said means for maintaining further comprising means for returning said blade to said equilibrium position after said blade is moved from said equilibrium position by application of an external force.

20. Apparatus in accordance with claim 19 further comprising a substantially flat plate adapted to be mounted to an upper surface of said ski, said maintaining means and said pivotable attachment means being positioned on said flat plate.

21. Apparatus in accordance with claim 20, wherein said means for pivotably attaching said second end of said blade to said ski comprises two bearings spaced apart from each other in a direction transverse to the longitudinal extent of said ski.

22. Apparatus in accordance with claim 21, wherein said pivotable blade includes a forward end and spaced apart lateral pivots located at said forward end, each of said pivots being insertable into respective ones of said bearings.

23. Apparatus in accordance with claim 19, wherein said blade includes a front end, a rear end, an upper surface, and a lower surface.

24. Apparatus in accordance with claim 23, further comprising a generally U-shaped support plate extending upwardly and rearwardly from the upper surface of said blade and comprising at least part of said means for attaching one end of said blade to the toe of said ski boot.

25. Apparatus in accordance with claim 24 further comprising a generally U-shaped bail attached to said two sides of said blade, said bail comprising means for fastening said boot toe to said blade.

26. Apparatus in accordance with claim 23, wherein said rear end of said blade is angled upwardly and forwardly.

27. Apparatus in accordance with claim 23, wherein said front end of said blade is angled upwardly and rearwardly.

28. Apparatus in accordance with claim 27, wherein an upper edge and a lower edge of said blade front are arcuate.

29. Apparatus in accordance with claim 23, wherein said front end of said blade is substantially vertical.

30. Apparatus in accordance with claim 23, wherein said front end of said blade is angled upwardly and forwardly.

31. Apparatus in accordance with claim 23, wherein said front end of said blade has an upper edge which curves rearwardly at a point adjacent to, and located slightly above, the mid-height point of said blade.

32. Apparatus in accordance with claim 23, wherein said rear end of said blade is integrally attached to a front end of said ski boot.

33. Apparatus in accordance with claim 19, wherein said means for maintaining said blade in an equilibrium position comprise a resiliently biasing member which is adapted to resiliently abut a forward end of said blade when said blade is pivotably connected to said ski.

34. Apparatus in accordance with claim 33, wherein said resiliently biasing member comprises a finger which is moveably biased along the longitudinal extent of said ski by a helical spring, said finger and said spring being located within a generally rectangular casing.

35. Apparatus in accordance with claim 34, wherein said finger includes a flange at a forward end thereof, said flange comprising means for engaging a flange located on an interior surface of said casing to limit rearward movement of said finger through an opening in a rear wall of said casing.

36. Apparatus in accordance with claim 34, wherein the compression of said spring is controlled by a screw which is threadably connected within an internally threaded bore located at a forward end of said casing.

37. Apparatus in accordance with claim 33, wherein said resiliently biasing member comprises a compressible block of material positioned between said spaced bearings which comprise at least part of said means for pivotably attaching said blade to said ski.

38. Apparatus in accordance with claim 37, wherein said block comprises a rear surface which is adapted to abut said front end of said blade and a front surface which is adapted to contact an abutment member positioned on said ski.

39. Apparatus in accordance with claim 38, wherein said block is substantially rectangular and wherein said front and rear block surfaces are substantially vertical 40. Apparatus in accordance with claim 38, wherein said front surface of said block is substantially vertical and said rear surface of said block is angled upwardly and forwardly.

41. Apparatus in accordance with claim 38, wherein said front surface of said block is substantially vertical and said rear surface of said block is angled upwardly and rearwardly.

42. Apparatus in accordance with claim 33, wherein said front blade surface and a rear surface of said resiliently biasing member abut each other adjacent a substantially horizontal axis which is located transverse to the horizontal extent of said ski and which is located within said means for pivotably attaching a second end of said blade to said ski.

43. Apparatus in accordance with claim 42, wherein said plane of abutment is substantially vertical and is located along said axis.

44. Apparatus in accordance with claims 42, wherein said plane of abutment is substantially vertical and is located forwardly of said axis.

45. Apparatus in accordance with claim 42, wherein said plane of abutment is substantially vertical and is located rearwardly of said axis.

46. Apparatus in accordance with claim 42, wherein said abutment plane is angled upwardly and rearwardly and intersects said axis.

47. Apparatus in accordance with claim 42, wherein said plane of abutment is angled upwardly and forwardly and intersects said axis.

48. Apparatus in accordance with claim 42, wherein said plane of abutment is angled upwardly and rearwardly and is located entirely forwardly of said axis.

49. Apparatus in accordance with claim 42, wherein said abutment plane is angled upwardly and rearwardly and is located entirely rearwardly of said axis.

50. Apparatus in accordance with claim 42, wherein said plane of abutment is angled upwardly and forwardly and is located forwardly of said axis.

51. Apparatus in accordance with claim 42, wherein said abutment plane is angled upwardly and forwardly and is located rearwardly of said axis.

52. Apparatus in accordance with claim 19, wherein said means for pivotably attaching a second end of said blade to said ski comprises a pair of spaced bearings, each of said bearings comprising a stationary member and a moveable member extending upwardly from said ski.

53. Apparatus in accordance with claim 52, said apparatus further comprising a slidable casing surrounding said means for maintaining said blade at an equilibrium position, said slidable casing comprising means for forcing said moveable bearing members towards said stationary bearing members.

54. Apparatus in accordance with claim 53, wherein said stationary members extend upwardly from a base, said stationary members being arcuate in configuration and curved forwardly with respect to the extent of said ski.

55. Apparatus in accordance with claim 54, wherein said moveable members of each of said bearings comprise side walls of said casing with an arcuate surface curved rearwardly with respect to the longitudinal extent of said ski.

56. Apparatus in accordance with claim 55, wherein said respective arcuate members are adapted to engage respective lateral pivots at a forward end of said blade.

57. Apparatus in accordance with claim 53, wherein said casing comprises a slidable cap.

58. Apparatus in accordance with claim 19, wherein said blade in said predetermined equilibrium position forms a predetermined angle with said ski.

59. Apparatus in accordance with claim 8 wherein said predetermined angle is between approximately 5° and 45°.

60. Apparatus in accordance with claim 59, wherein said predetermined angle is approximately 20°.

* * * * *

UNITED STATES PATENT AND TRADEMARK OFFICE

CERTIFICATE OF CORRECTION

PATENT NO. : 4,801,154

DATED : January 31, 1989

INVENTOR(S) : LINKAGE DEVICE BETWEEN A CROSS - COUNTRY SKI AND A BOOT

It is certified that error appears in the above-identified patent and that said Letters Patent is hereby corrected as shown below:

At column 6, line 3, change "FIG. 3" to —FIG. 3.—.

At column 7, line 68, change "horizontal" to —horizontal.—.

At column 14, line 18, change "said is" to —said angle is approximately—.

At column 15, line 48, change "vertical" to —vertical.—.

Signed and Sealed this

Twenty-second Day of January, 1991

*Attest:*

HARRY F. MANBECK, JR.

*Attesting Officer*

*Commissioner of Patents and Trademarks*